United States Patent [19]

Kägi et al.

[11] Patent Number: 4,879,887

[45] Date of Patent: Nov. 14, 1989

[54] CONTINUOUS FLOW WASHING MACHINE

[75] Inventors: Rudolf Kägi, Hadlikon-Hinwil; Eugen Baumgartner, Wolfhausen, both of Switzerland

[73] Assignee: Maschinenfabrik Ad. Schulthess & Co. AG, Zurich, Switzerland

[21] Appl. No.: 173,054

[22] Filed: Mar. 25, 1988

[30] Foreign Application Priority Data

Mar. 27, 1987 [CH] Switzerland ..... 1177/87

[51] Int. Cl.[4] ..... D06F 31/00

[52] U.S. Cl. ..... 68/16; 68/24; 68/27; 68/207; 68/210

[58] Field of Search ..... 68/15, 16, 24, 27, 58, 68/143, 145, 207, 210

[56] References Cited

U.S. PATENT DOCUMENTS

| | | | |
|---|---|---|---|
| 3,210,969 | 10/1965 | Sulzmann | 68/58 |
| 3,293,891 | 12/1966 | Sulzmann | 68/207 X |
| 3,550,406 | 12/1970 | Jack, Jr. et al. | 68/210 X |
| 4,034,583 | 7/1977 | Miessler | 68/143 X |
| 4,094,172 | 6/1978 | Arendt | 68/58 |
| 4,499,621 | 2/1985 | Gasser | 8/158 |
| 4,546,511 | 10/1985 | Kaufmann | 8/158 |
| 4,694,665 | 9/1987 | Stoll | 68/27 |

FOREIGN PATENT DOCUMENTS

| | | | |
|---|---|---|---|
| 0083302 | 11/1982 | European Pat. Off. . | |
| 0088052 | 2/1983 | European Pat. Off. . | |
| 2226373 | 5/1972 | Fed. Rep. of Germany . | |
| 2424231 | 12/1974 | Fed. Rep. of Germany . | |
| 443208 | 10/1966 | Switzerland . | |
| 615716 | 2/1980 | Switzerland | 68/207 |

*Primary Examiner*—Philip R. Coe

*Attorney, Agent, or Firm*—Bernard, Rothwell & Brown

[57] ABSTRACT

The washing machine has a prewash chamber (11), a clear wash chamber (2), and a rinse chamber (3) in a tube (4). The chambers are separated from each other by separating walls (5, 6) having transfer openings. During the cycle period, which is defined by successive transfers of the laundry from one respective chamber (1, 2, 3) to the next, the rinse water in the rinse chamber (3) is changed more than once. The first rinse water is collected in a tank (47) and heated to the clear wash temperature during the cycle period. Before the end of the cycle the prewash water is drained from the prewash chamber (1) and the preheated clear wash water is filled into the prewash chamber (1). At the end of the cycle, the prewashed laundry together with the clear wash water passes into the clear wash chamber (2). This chamber can be heated via a steam connector fitting (43).

8 Claims, 3 Drawing Sheets

CONTINUOUS FLOW WASHING MACHINE

Figure 1:
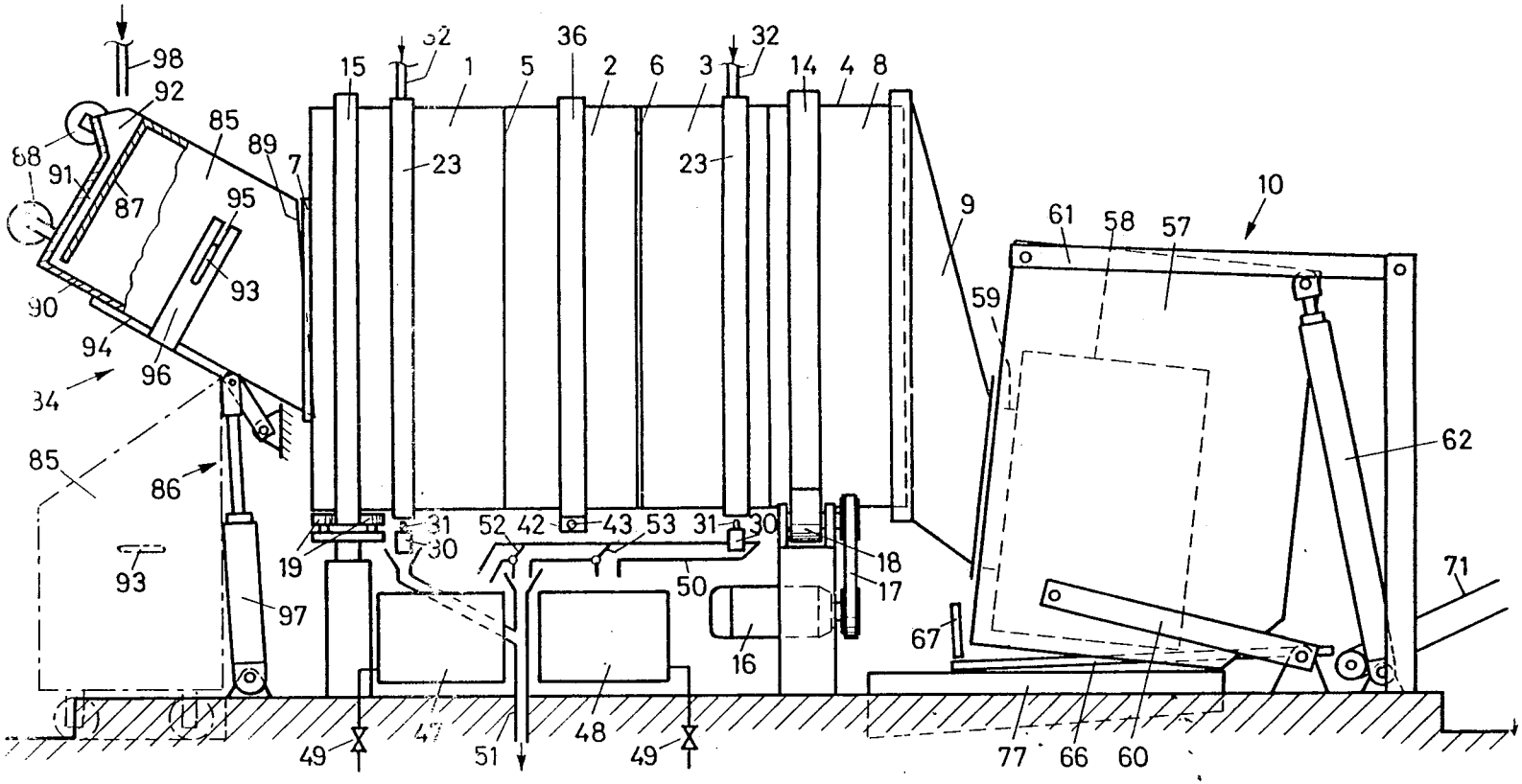

A washing method and an assoicated washing machine are known from U.S. Pat. No. 4,499,621. This continuous flow washing machine has five chambers in a tube separated by separating walls with transfer openings. The transfer openings are all arranged on the same side of the tube and are formed by helical surfaces wich connect one chamber wall with the next and extended to the tube wall. In operation the transfer openings are in the upper part during a wash cycle and the tube swings back and forth about its longitudinal axis through an angle of about 315 degrees. At the end of the cycle the tube makes one additional full revolution, so that the laundry batches pass through the transfer openings into the respective next chamber. After the last rinse process in the last rinse chamber, the clean laundry is dewatered in a dewatering device, e.g., a centrifuge or a press. The dirty laundry is filled into a funnel at the front end of the prewash chamber and the prewash water is combined therewith at the beginning of the wash cycle.

In the washing machine according to U.S. Pat. No. 4,499,621 the requisite number of chambers was reduced as compared to older continuos flow washing machine by virtue of the fact that the rinse water in the two rinse chambers was changed after half of the cycle period.

These washing machines work well in practice. However, they still require a significant amount of space. The object of the present invention is a washing method and a continuous flow washing machine which requires less space. The machine should be formed as compactly as possible.

In one aspect of the invention this object is achieved by a method for washing laundry in a continuous flow washing machine including a tube that is divided by separating walls with transfer openings into a single prewash chember, a single clear wash chamber and a single rinse chamber, a loading device for introducing laundry into the prewash chamber and a dewatering device connecte to the rinse chamber, wherein the rinse water in the rinse chamber is changed more than once within one cycle period defined by successive transfers of the laundry from one chamber to the next, wherein during the cycle period the clear wash water is heated in the clear wash chamber, and wherein prior to the end of the cycle period, the prewash water in the prewash chamber is drained and the preheated new clear wash water is introduced into the prewash chamber.

In another aspect of the invention there is provided a continuous flow washing machine comprising a tube containing a single prewash chamber, a single clear wash chamber and a single rinse chamber, wherein the prewash chamber includes a first sluice gate, the clear was chamber includes a second sluice gate, and the rinse chamber includes the third sluice gate, wherein the clear was chamber is heatable through the second sluice gate, wherein the prewash chamber can be drained into a drain through the first sluice gate, wherein the rinse chamber can be drained selectively through the third sluice gate into either a heatable tank or into an additional water receiving unit and can be filled by means of a supply member, and wherein the prewash chamber can be filled from the tank.

Because the clear wash chamber in the machine according to the invention can be heated directly, it is possible to perform the entire clear washing process in a single chamber. Since at the beginning of a cycle the laundry, together with the preheated clear wash water, is transported into the clear wash chamber, the entire length of the cycle period can be utilized for the clear wash process and the temperature can be controlled over the entire cycle period. In this manner, with a cycle period of, for example, 14 minutes at 95 degrees C., the termal desinfection of the laundry can be achieved. This cycle period is sufficient to change the rinse water in the single rinse chamber three times, in order to achieve four rinse processes. The machine according to the invention therefore requires only three chambers, so that it is significantly more compact than known machines.

Figure 2:
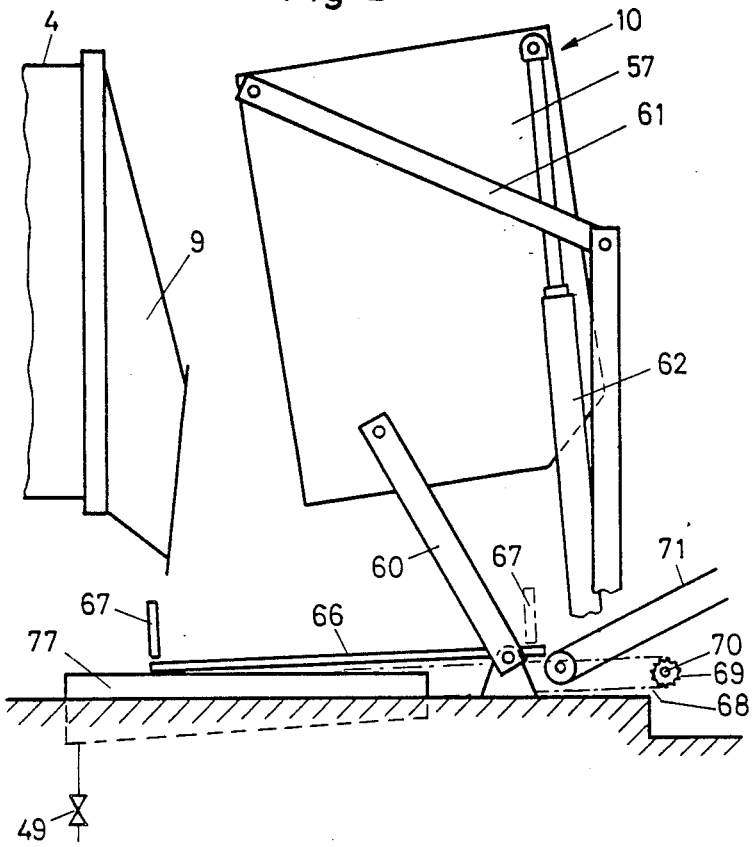
Figure 4:
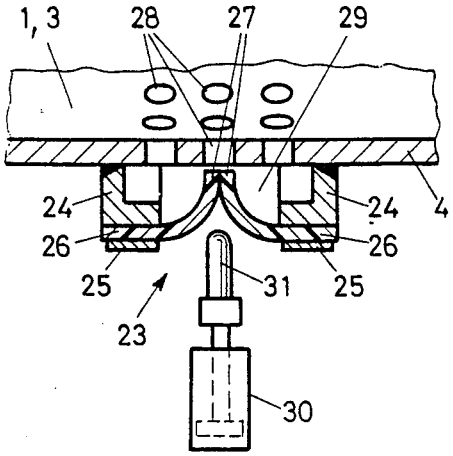
Figure 5:
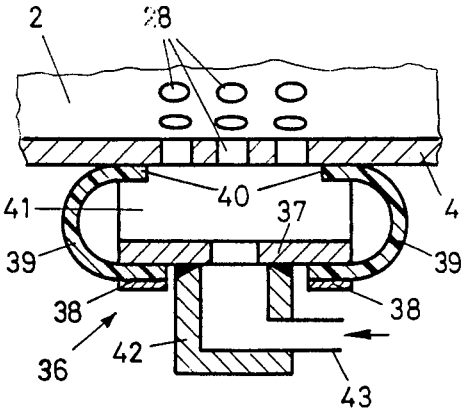
Figure 3:
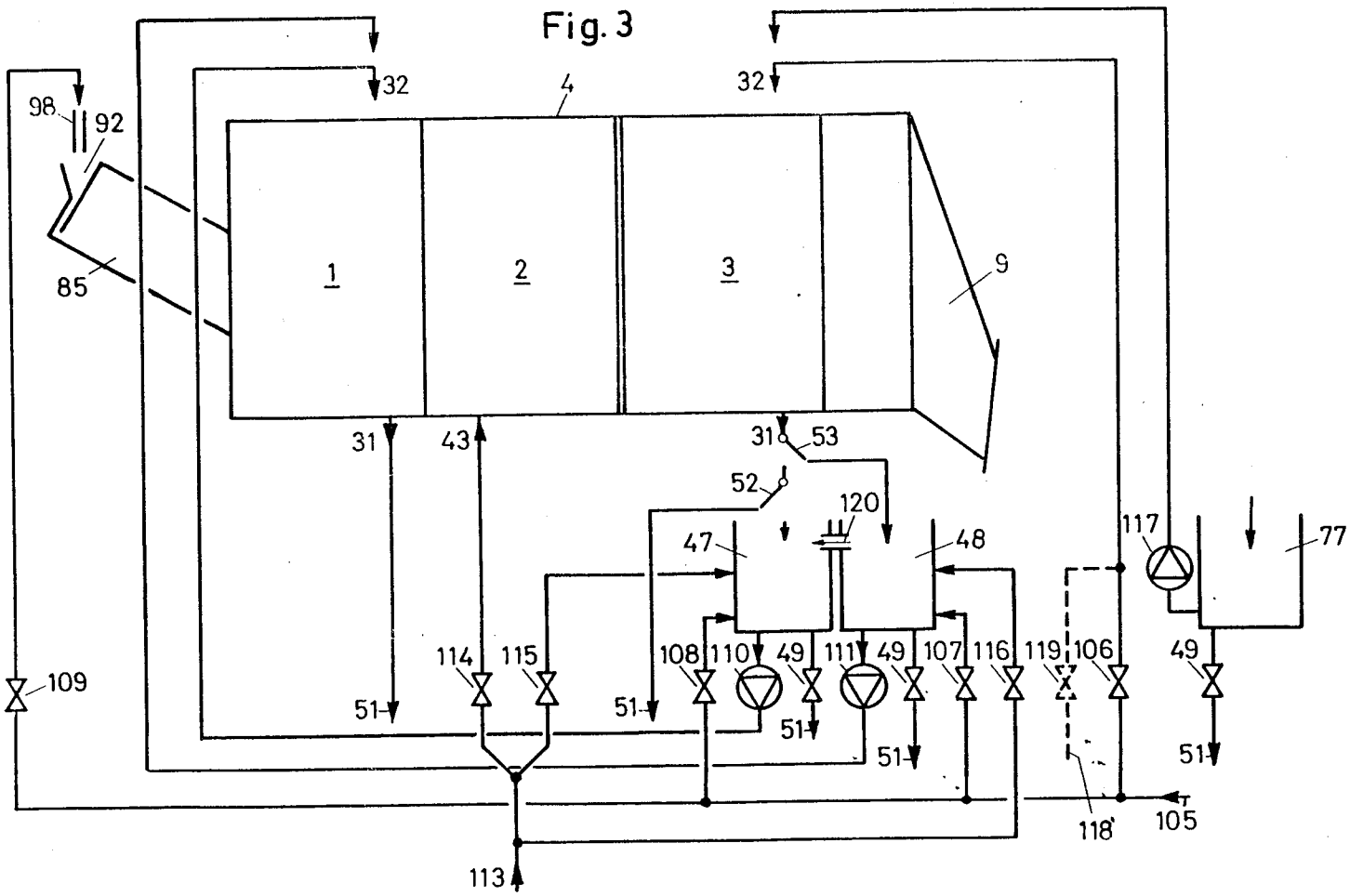

An exemplary embodiment of the invention is described below with the reference to the drawings, wherein FIG. 1 is a side view of a washing machine, FIG. 2 shows the centrifuge in the raised position, FIG. 3 is a circuit diagram, FIG. 4 is a section through a sluice gate, and FIG. 5 is a section through an additional sluice gate.

The continuous flow washing machine illustrated in FIG. 1 includes a tube 4 with three chambers, 1, 2, 3, namely a prewash chamber 1, a clear wash chamber 2 and a rinse chamber 3. The chambers 1, 2, 3 are separated from each other by separating walls 5 and 6. The walls S, 6 on one side of the tube 4 have transfer openings (not shown), which extend to the wall of the tube. At the entry end, the prewash chamber 1 has a coaxial loading opening 7. At the discharge end a conveyor helix (not shown) adjoins the rinse chamber 3 in an additional section 8 of the tube 4, which conveyor helix transfers the clean laundry into a centrifuge 10 via a discharge funnel 9.

Two track rings 14 and 15 are attached to the tube 4. The ring 14 runs on two support rollers 18 that are driven by a reversible motor 16 via toothed belts 17. The ring 15 is also supported on support rollers (not shown) and is guided axially by guide rollers 19. The chambers 1 and 3 each have a sluice gate 23 at the outer circumference of the tube 4 (FIG. 4). The sluice gates 23 consists of two rings 24 welded to the outer circumference of the tube 4 and spaced from each other, and two rubber flanges 26 that contact each other and are attached to the rings 24 with straps 25. The free lips 27 of the flanges 26 are directed toward the tube 4 Between the rings 24, a portion of the tube 4 has bore openings 28, so that the chambers 1, 3 communicate with the chamber 29 enclosed by the tube 4, the rings 24 and the flanges 26. Respective pneumatic cylinder groups 30 are arranged on the underside of the chambers 1, 3. The piston rods of these pneumatic cylinder groups 30 each support a finger 31, which are spaced from each other in the circumferential direction of the tube 4. When the cylinders 30 are activated, the fingers 31 engage between the lips 27 and spread them apart, so that the chambers 1, 3 can be drained through the intermediate spaces between the fingers 31. Above the water level, a hollow blade-like member 32, which is wedge-shaped on both sides, is inserted between the lips 27, and water, liquid washing agents or a neutralization agent can be filled into the chambers 1, 3 through this blade-like member 32. The chamber 2 also has a sluice gate 36, which, however, is formed differently (FIG. 5). A ring 37 which is held stationary relative to the machine housing, is guided coaxially to the tube 1 by means of rollers (not shown). Two rubber ring flanges 39 are attached to the ring 37 with straps 38. The free lips 40 of the flanges 39, which are directed towards each other, abut the tube 4. The chamber 41 enclosed by the tube 4, the ring 37 and the flanges 39 communicates with the chamber 2 through bore openings 28. A support 42 with a steam connector fitting 43 is welded to the ring 37. Steam can be blown into the chamber 41 through the fitting 43, thereby heating the chamber 2. Additional fittings, e.g. for a water level indicator or for the adding of a washing agent, can also be located on the ring 37.

Two tanks 47, 48 to store rinse water are arranged beneath the tube 4. Both tanks, 47, 48 can be heated with steam and can be emptied into a drain pipe via respective valves 19. A channel 50 is arranged below the fingers 31 at the sluice gate 23 of the chamber 3, which channel 50 conducts the rinse water passing through the opened sluice gate 23 to the tanks 47, 48 or into a drain pipe 51. Two flaps 52, 53 in the bottom of the channel control the water flow. If both flaps 52, 53 arc down, the rinse water passes into the tank 47. If the flap 52 is raised, it passes into the drain pipe 51. If the flap 53 is raised, the rinse water is conducted into the tank 48.

The centrifuge 10 has a drum 58 which is resiliently mounted in a housing 57 and has an axial opening 59, which in the lowered position illustrated in FIG. 1 lies adjacent to the discharge opening of the output funnel 9. In this position the drum axis is downwardly inclined. The drum 58 is driven by an speed-controlled motor. The housing 57 is connected on both sides to the free ends of two pivot levers 60, 61 of unequal length. The housing 57 can be pivoted upwards by means of two pneumatic cylinders 62 into the upper limit position illustrated in FIG. 2. By this means the centrifuge 10 is raised and simultaneously the forward end of the drum axis is tipped downward, so that at low drum rpm's the drum content is discharged through the opening 59 onto a slide plate 66.

The slide plate 66 is inclined slightly upwards towards the discharge end, and in cross-section is slightly V-shaped. At its end facing the tube 4 it is perforated. Below the discharge funnel 9, in the basic position, there is located a shovel plate 67 which projects perpendicularly upward from the plate 66. This shovel plate 67 is attached on both sides to respective chains 68. The two chains 68 move synchronously by means of chain wheels 69. The chain wheels 69 are disposed on a common drive shaft 70. The shovel plate 67 (by means of a motor not shown) can travel out of the basic position illustrated with solid lines into the end position illustrated with broken lines, and thereby push the laundry on the plate 66 onto a conveyor belt 71. This type of unloading of the centrifuge allows for a short construction and is extremely simple and rapid, so that the unloading process requires only a short time. Therefore the cycle period can be largely utilized for spinning. The described push-out device is also suitable for other washing machines having centrifuges connected thereto.

Beneath the perforated area of the plate 66 there is arranged an additional tank 77 which captures the last rinse water spun off by the centrifuge 10 and the rinse water passing out of the discharge funnel 9 with the laundry during the cycle change. The tank 77 is also connected with the drain pipe by means of an additional drain valve 49.

A loading device 84 serves for loading the prewash chamber 1, and includes a loading container 85 and a lifting device 86. Four castor rollers 88 are attached to the bottom 87 of the container 85. The upper edge 89 of the cylindrical wall 90 of the container 85 is cut off at an angle to bottom 87 thereof. A channel 91 extends diagonally above the bottom 87. This channel 91 opens into the container 85 on its longer wall side and on the opposite side into an outwardly open funnel 92. Two grips 93 are located on the wall 90. In the lowered position of a pivot lever 94, these grips pass into slots 95 of a U-shaped support 96 welded to the lever 94. By raising the lever 94 by means of a pneumatic cylinder 97, the container 85 is lifted into the position illustrated in FIG. 1, where it projects into the loading opening 7 with the lower portion of the edge 89. The open end of a water supply pipe 98 thereby aligns with the funnel 92. The laundry contained in the container 85 is then rinsed into the chamber 1 by water supplied through the pipe 98 to the funnel 92 and the channel 91. In the lowered position of the container 85 the loading opening 7 is closed by a cover (not shown).

As shown in FIG. 3, a fresh water supply line 105 is connected with the blade-like member 32 of the chamber 3, with the tanks 47, 48 and with the tube 98 by means of respective valves 106, 107, 108, 109. The tanks 47, 48 each feed a respective pump 110, 111, the output of which is connected with the blade like member 32 of the chamber 1. A steam supply line 113 feeds three steam valves 114, 115, 116. These are connected with the steam connector fitting 43 and the two tanks 47, 48. The content of the tank 77 can be supplied to the blade-like member of the chamber 3 via a pump 117. A hot water connection 118 with an additional valve 119 may be connected with this blade-like member 32. An overflow 12O can be provided between the tanks 47, 48.

The described washing machine operates as follows :

At the end of an operation cycle, i.e., when the tube 4 has been rotated through a full revolution, the prewash chamber 1 is empty, the clear wash chamber 2 is loaded with the prewashed laundry together with the clear wash water, and in the rinse chamber 3 is the clear washed laundry together with the wash water. The tube 4 swings back and forth. The container 85 with the dry dirty laundry is in the raised position according to FIG. 1. The tank 17 is empty and the second and a portion of the third rinse water from the previous cycle is located in the tank 48. The tank 77 contains the last rinse water of the previous cycle.

At the beginning of the new cycle the valve 109 is opened and the laundry is rinsed out of the container 85 into the chamber 1 with fresh water. At the same time the pump 111 is turned on and with the pump 111 the content of the tank 48 is pumped into the chamber 1 through the blade-like member 32. The dirty laundry is prewashed in the chamber 1. The chamber 2 is heated with steam supplied via the valve 114 and the fitting 43. In the chamber 3, first the fingers 31 are inserted to drain the clear wash water into the drain pipe SI, whereby in the illustration according to FIG. 1 the flap 53 is down and the flap 52 is up. As soon as the chamber 3 is empty, it is filled by the pump 117 through the blade-like member 32 from the tank 77 with the last rinse water from the previous cycle. After approximately one quarter of the cycle period this first rinse water, which is about 45 degrees C. warm, is conducted through the channel 50 into the tank 47 when the fingers 31 are inserted, whereby in the illustration according to FIG. 1, both flaps 52, 53 are down. In the tank 47 this first rinse water is heated to about 95 degrees by opening the valve 115. As soon as the first rinse water has drained, the fingers 31 are retracted and the remainder of the content of the tank 77 is pumped into the chamber 3 with the pump 117. Any additional water required is supplied by opening the valve 106. After about half of the cycle period the second rinse water is drained from the chamber 3 into the tank 48, whereby the flap 53 (FIG. 1) is up. Then, in chamber 3 fresh water is supplied through the valve 106 for the third rinse. Depending on the desired prewash temperature, the chamber 48 can be heated by opening the seam valve 116. After about ¾ of the cycle period the fingers 31 of the chamber 1 are activated and the prewash water is drained into the drain pipe 51. Subsequently, the chamber 1 is loaded with the clear wash water, which has been preheated to the clear wash temperature, by turning on the pump 110. Simultaneously, the third rinse water also passes into the tank 48 by insertion of the fingers 31 of the chamber 3. Eventual excess water either flows over the overflow 120 into the tank 47 or is conducted into the drain pipe 51 by lowering the flap 53 and raising the flap 52. For the fourth rinse, fresh water is again filled into the chamber 3 via the valve 106. At the end of the cycle the tube 4 is rotated through a complete revolution, thereby attaining the initial condition, and the finished laundry, together with the last rinse water, passes out of the chamber 3 through the discharge funnel 9 into the centrifuge 10. The last rinse water thereby fills the tank 77. During the next cycle the laundry is spun in the centrifuge 10 and finally unloaded onto the plate 66 by raising the centrifuge 10 and then transparted away. In the course of the cycle the pivot lever 94 was also lowered and a filled container 85 was introduced and raised.

With mixed fabrics it is desirable to slowly cool the wash water after the wash cycle. This can be achieved in that at the beginning of the cycle the sluice gate 23 of the chamber 3 is opened only intermittently by the fingers 31 and simultaneously, water is supplied with the pump 117 intermittently. It is also possible, however, to heat the first rinse water by opening the valve 119.

If a different type of fabric is to be washed, the tanks 47, 48, 77 are first emptied through the valves 49 and subsequently the tanks 47, 48 are refilled via the valves 108, 107. If fresh water is to be used for all rinses, the discharge valve 49 of the tank 77 remains open and the rinse chamber 3 is supplied with water exclusively via the valves 106, 119.

The described machine is extremely versatile in its programmability. The numer of rinses can be selected relatively freely. Because the clear wash water in tank 47 can be preheated, the clear wash process can be started in the chamber 1 at any desired point in the cycle. Therefore it is possible to reduce the cycle period if only a small amount of prewashing is required. The heating of the clear wash chamber 2 via the sluice gate 36 with steam allows a rapidly effective temperature control. Because the tank 77 is connected with the wash tube 4 only through the pump 117, an effective physical separation of the clean area from the area of dirty laundry is possible.

The illustrated and described loading device 84 can also be used with other washing machines. It allows for a significantly shorter construction, because the inclined conveyor belts that are otherwise necessary to lift the laundry into the filling funnel are eliminated. In addition, the batch-wise preparation of the dirty laundry is greatly simplified.

We claim:

1. Continuous flow washing machine comprising a tube (4) containing a single prewash chamber (1), a single clear wash chamber (2) and a single rinse chamber (3), wherein the prewash chamber (1) includes a first sluice gate (23), the clear wash chamber (2) includes a second sluice gate (36), and the rinse chamber (3) includes the third sluice gate (23), wherein means (43) are provided for heating clear wash water in the clear wash chamber (2) through the second sluice gate (36), wherein the prewash chamber (1) is selectively drained into a drain through the first sluice gate (23), wherein the rinse chamber (3) is drained selectively through the third sluice gate (23) into either a tank (47) comprising means for heating water in the tank or into an additional water receiving unit (48, 51) and is filled by means of a supply member (32), and wherein the prewash chamber (1) is selectively filled from the tank (47).

2. Machine according to claim 1, wherein the additional water receiving unit includes a second tank (48) to receive the second and third rinse water and a drain (51), and wherein the content of the second tank (48) is selectively passed into the prewash chamber (1).

3. Machine according to claim 2, wherein the second tank (48) comprises means for heating water in the second tank.

4. Machine according to claim 3, further comprising a dewatering device (10) a third tank (77) beneath the dewatering device for receiving the last rinse water, which third tank (77) is connected with the supply member (32) through the third sluice gate (23) via a pump (117) and is selectively drained to a drain (51).

5. Machine according to claim 1, wherein the water removal device (10) is a centrifuge having a rotatable drum (58) in a liftable and tippable housing (57), wherein a slide plate (66) is arranged beneath the housing (57), and wherein a slider (67) for pushing the laundry onto a conveyor belt slides above the slide plate (66).

6. Machine according to claim 1, further comprising a loading device (84) which includes a raisable and tippable laundry container (85) having a wall (90), the upper edge (89) of which is inclined with respect to a bottom (87) and a channel (91) running diagonally across the bottom (87) being open on the longer side of the wall (90) towards the interior of the container and on the shorter side of the wall (90) opening into an outwardly open funnel (92), whereby the funnel (92), when the container (85) is in its raised position, aligns with the open end of the water supply pipe (98).

7. Machine according to claim 6, wherein rollers (88) are attached to the bottom (87) of the container (85), and wherein the container (85) is detachably connected with a pivot arm (94) for raising and tipping the container (85).

8. Machine according to claim 6, wherein the water supply pipe (98) is connected with a fresh water supply line (105) by means of a valve (109), and wherein the clear wash water is selectively directed into the prewash chamber (1) through the first sluice gate (23) by means of an additional supply member (32).

* * * * *

UNITED STATES PATENT AND TRADEMARK OFFICE

CERTIFICATE OF CORRECTION

PATENT NO. : 4,879,887

DATED : November 14, 1989

INVENTOR(S) : Rudolf Kagi, Eugen Baumgartner

It is certified that error appears in the above-identified patent and that said Letters Patent is hereby corrected as shown below:

Column 1, Line 4, delete "assoicated" and substitute therefor --associated--;

Column 1, Line 9, delete "wich" and substitute therefor --which--;

Column 1, Line 26, delete "continuos" and substitute therefor --continuous--;

Column 1, Line 40, delete "chember" and substitute therefor --chamber--;

Column 1, Line 43, delete "connecte" and substitute therefor --connected--;

Column 1, Line 57, delete "was" and substitute therefor --wash--;

Column 1, Line 59, delete "was" and substitute therfor --wash--;

Column 2, Line 9, delete "termal desinfection" and substitute therefor --thermal disinfection--;

Column 2, Line 29, delete "S" and substitute therefor --5--;

UNITED STATES PATENT AND TRADEMARK OFFICE

CERTIFICATE OF CORRECTION

PATENT NO. : 4,879,887

DATED : November 14, 1989

INVENTOR(S) : Rudolf Kagi, Eugen Baumgartner

It is certified that error appears in the above-identified patent and that said Letters Patent is hereby corrected as shown below:

Column 2, Line 48, after "4" insert --.--;

Column 2, Line 68, delete "1" and substitute therefor --4--.

Column 3, Line 15, delete "19" and substitute therefor --49--.

Column 4, Line 28, delete "blade like" and substitute therefor --blade-like--;

Column 4, Line 36, delete "12O" and substitute therfor --120--;

Column 4, Line 46, delete "17" and substitute therefor --47--;

Column 4, Line 59, delete "SI" and substitute therefor --51--.

Column 5, Line 33, delete"transparted" and substitute therefor --transported--.

Column 6, Line 32, delete "3" and substitute therefor --1--;

UNITED STATES PATENT AND TRADEMARK OFFICE

CERTIFICATE OF CORRECTION

PATENT NO. : 4,879,887

DATED : November 14, 1989

INVENTOR(S) : Rudolf Kagi, Eugen Baumgartner

It is certified that error appears in the above-identified patent and that said Letters Patent is hereby corrected as shown below:

Column 6, Line 55, delete "the" (second occurrence) and substitute therefor --a--.

Signed and Sealed this

Eighth Day of October, 1991

*Attest:*

HARRY F. MANBECK, JR.

*Attesting Officer*

*Commissioner of Patents and Trademarks*